United States Patent [19]

Horgan, Jr.

[11] Patent Number: 4,895,399

[45] Date of Patent: Jan. 23, 1990

[54] PANIC HANDLE FOR DOORS

[75] Inventor: William J. Horgan, Jr., Pittsburgh, Pa.

[73] Assignee: Blumcraft of Pittsburgh, Pittsburgh, Pa.

[21] Appl. No.: 169,997

[22] Filed: Mar. 18, 1988

[51] Int. Cl.[4] ..... E05C 15/02

[52] U.S. Cl. ..... 292/92; 292/336.3

[58] Field of Search ..... 292/92, 93, 21, 263, 292/336.3, 226

[56] References Cited

U.S. PATENT DOCUMENTS

| | | | |
|---|---|---|---|
| 1,494,403 | 5/1924 | Ayres | 292/263 |
| 2,945,372 | 7/1960 | Reed | 292/92 X |
| 3,214,947 | 11/1965 | Wikkerink | 292/92 X |
| 4,366,974 | 1/1983 | Horgan, Jr. | 292/92 X |
| 4,382,620 | 5/1983 | Horgan, Jr. | 292/92 |
| 4,418,949 | 12/1983 | Horgan, Jr. | 292/92 |

*Primary Examiner*—Richard E. Moore
*Attorney, Agent, or Firm*—Paul & Paul

[57] ABSTRACT

A panic device for doors comprises a bar disposed horizontally along and carried by the inside of a door and mounted thereto for limited pivotal movement of the bar between positions toward and away from the door, a latching assembly affixed to the door and disposed within the bar, the latching assembly having a latch sub-assembly in operable engagement with the bar whereby upon movement of the bar between positions toward and away from the door, the latch sub-assembly is actuated to unlatch or latch the door. Additional embodiments include an optional stationary exterior door handle, a lock cylinder and crank sub-assembly for actuating the latch sub-assembly from the exterior of the door, and a dogging device for selectively operating the bar in a panic mode or as a stationary door handle.

29 Claims, 4 Drawing Sheets

Fig. 1
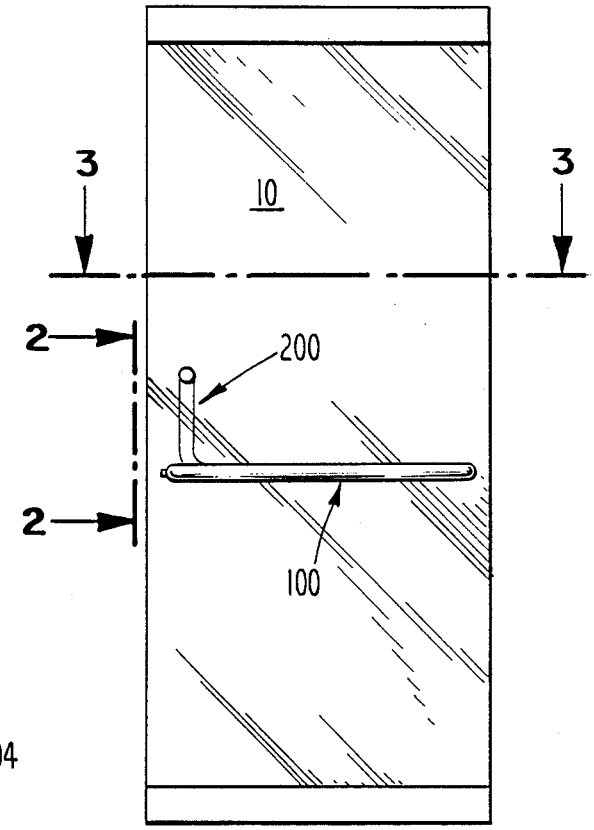
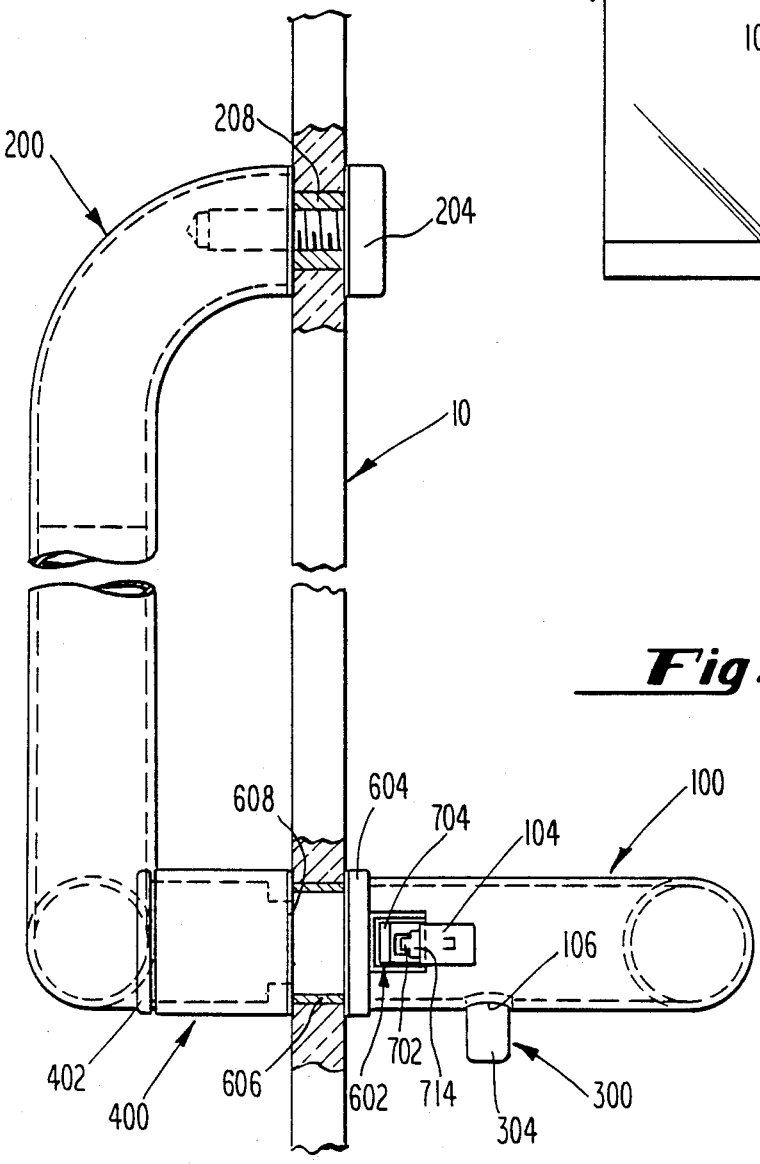
Fig. 2

PANIC HANDLE FOR DOORS

BACKGROUND OF THE INVENTION

This invention relates to panic handles for doors and the like and more particularly relates to panic handles of the type generally referred to in the art as a rim-type panic device.

Many types of panic handles for doors and the like are generally known in the art. Examples of one type of panic handle are described in detail in my prior U.S. Pat. Nos. 4,366,974, issued Jan. 4, 1983; 4,382,620, issued May 10, 1983; and 4,418,949, issued Dec. 3, 1983, the disclosures of which are incorporated herein by reference. These above-mentioned patents teach a panic handle having a bar disposed along and carried by the inside of a door and a latch mechanism concealingly longitudinally disposed in the bar whereby upon movement of the bar toward the door, a series of events occurs to retract the latch bolt into the bar to unlatch the door. In that type of panic device, the latching action occurs at one of the horizontal edges of the door, depending upon the orientation of the bar. A key operable lock cylinder or the like may be provided for unlatching the door from the exterior, if desired.

Another type of panic handle generally known comprises a horizontal bar pivotally mounted to a door wherein upon movement of the bar toward the door, a latch bolt at the horizontal edge of the door is retracted to unlatch the door. Examples of such panic handles have been widely used for exit doors in schools and similar buildings where aesthetic appearance is not a major consideration. U.S. Pat. No. 3,264,025 to Hawes discloses a door latch which is actuated by movement of a bar toward and away from the door.

SUMMARY OF THE INVENTION

I have invented a new rim-type panic handle for doors and the like which is particularly suitable for use with doors made of glass or similar clear material. Briefly, the present invention comprises a bar disposed horizontally along and carried by the inside of a door, means for mounting the bar to the door for limited pivotal movement between positions toward and away from the door, and a latching assembly affixed to the door and disposed within the bar and cooperating therewith, wherein upon movement of the bar toward the door, the latching assembly is actuated to unlatch the door. Also provided is a dogging device to affix the bar in the unlatched position wherein the bar operates as a stationary door handle. The latching assembly comprises a latch sub-assembly which is actuated by movement of the bar. If desired, the latching assembly may also comprise a crank sub-assembly cooperating with the latch sub-assembly for use in latching and unlatching the door from the exterior by use of a key operable lock cylinder or the like. Also provided is a stationary door handle for the exterior of the door, if desired.

Accordingly, it is a primary object of the invention to provide a novel panic handle for doors.

It is another object of the invention to provide a panic handle wherein the latching action occurs at the vertical edge of the door.

It is another object of the invention to provide a panic handle having alternate modes of operation between a movable panic handle and a stationary handle.

It is yet another object of the invention to provide a panic handle for doors having a horizontal bar along and carried by the inside of a door, means for pivotally mounting the bar to the door for limited movement between positions toward and away from the door, and a latching assembly affixed to the door and cooperating with the bar to latch and unlatch the door in response to movement of the bar.

It is another object of the invention to provide a panic handle having a latching assembly which can be operated to latch or unlatch the door from the exterior of the door.

It is still another object of the invention to accomplish the above objects in a panic handle that is aesthetically pleasing in appearance.

These and other objects of the present invention will become apparent upon a further reading of the specification and the appended claims.

BRIEF DESCRIPTION OF THE DRAWINGS

FIG. 1 is a front elevational view of a typical glass door, as viewed from the interior thereof, with a panic handle in accordance with the present invention affixed thereto.

FIG. 2 is a partially fragmented, partially sectioned, side view of the glass door and panic handle of FIG. 1 as seen along line 2—2 of FIG. 1.

DETAILED DESCRIPTION OF THE EMBODIMENTS

Figure 3:
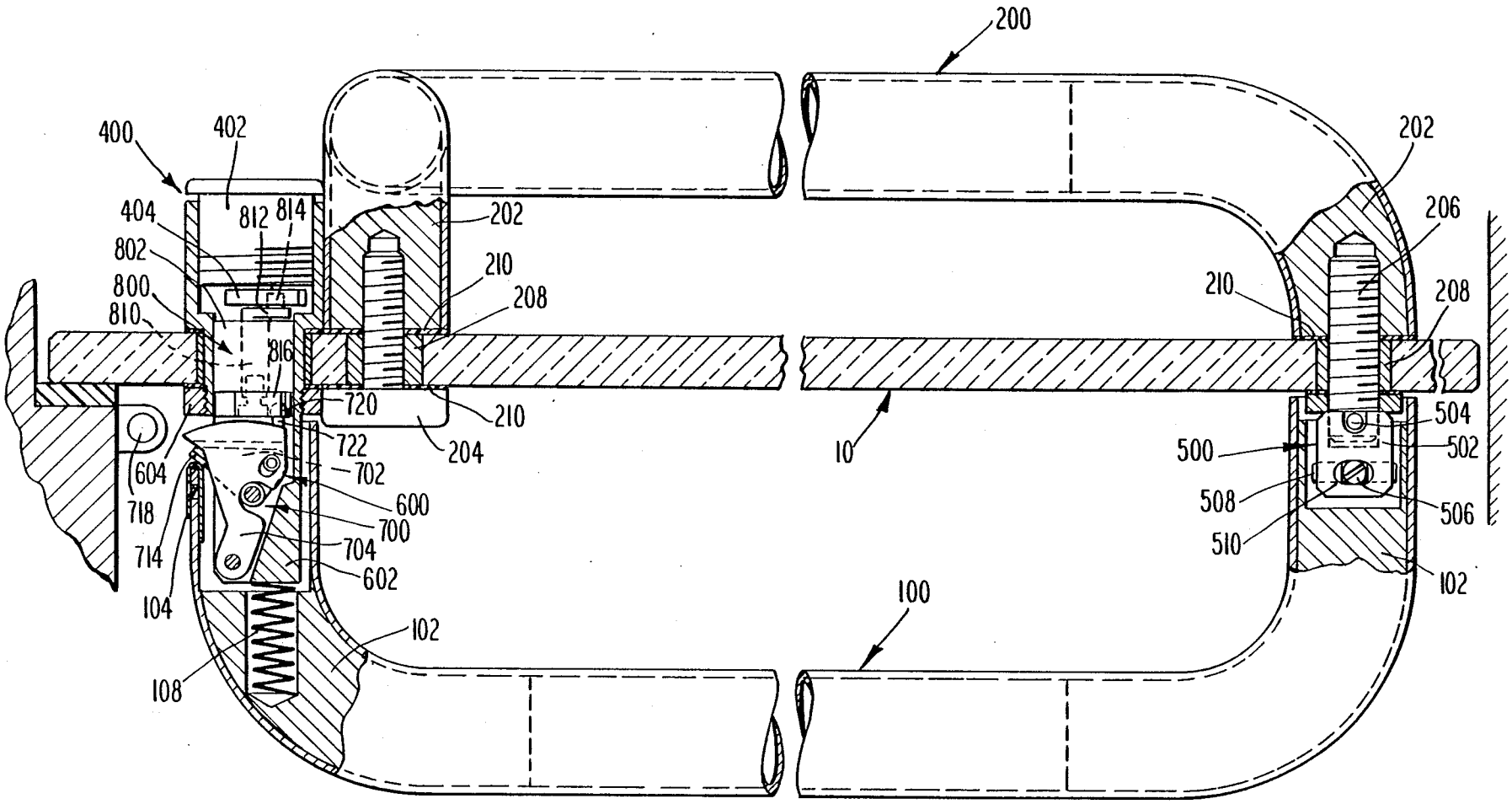
FIG. 3 is a partially fragmented, partially sectioned plan view of the glass door and panic handle of FIG. 1 as seen along line 3—3 of FIG. 1, showing the panic handle in a dogged position, whereby the door is unlatched.

With reference first being made to FIGS. 1 and 2, illustrated therein is a preferred embodiment of the panic handle of the present invention applied to a typical glass door 10. In the preferred embodiment, as illustrated, the present invention comprises a bar 100 disposed along and carried by the interior of door 10 and a second bar 200 disposed along and carried by the exterior of door 10. The exterior handle 200 is optional and may be used as desired without affect upon the operation of the panic handle of the present invention. When used, exterior handle 200 is affixed to door 10 in a stationary, non-movable position and operates as any normal, stationary door handle. Thus, the optional exterior handle 200 is preferred in those instances where an exterior door handle is desirable or otherwise necessary, such as, for example, where the panic handle is being used on entrance doors for a building. In addition, exterior handle 200 is particularly advantageous when used in connection with interior handle 100 on a glass door. As seen in FIG. 1, handles 100 and 200, when affixed to a glass door, present a smooth, uncluttered appearance and further create the illusion of a single bar passing through the glass, which results in a unique and pleasing aesthetic appearance. It is to be understood, however, that the panic handle of the present invention, with or without the optional exterior handle 200, may be used on a variety of doors and is not limited in application to glass doors.

In contrast to exterior handle 200, interior handle 100 is pivotally mounted to the door 10 for limited movement between positions toward and away from the door. As illustrated in FIG. 2, interior handle 100 is dogged in the forewardmost position by the interaction of dogging assembly 300 (yet to be described) and handle 100. As will be described more fully hereinafter, when dogged in its forewardmost position as illustrated in FIG. 2, handle 100 operates as a fixed, stationary door handle and the latching assembly is actuated whereby the door 10 is in an unlatched position.

In those situations where it is desirable, a lock cylinder assembly 400 may be used to actuate the latching assembly from the exterior of the door to latch or unlatch the door. For example, the use of the lock cylinder assembly 400 may be desirable when the panic handle is employed on entrance doors, but may be disadvantageous or otherwise undesirable in those instances when the panic handle of the present invention is utilized on fire exits or the like which are not normally used to gain access to a building.

With reference now being made to FIG. 3, the ends of exterior handle 200 are filled with a suitable filler material 202, such as aluminum or brass, to facilitate the attachment of handle 200 to the door. Suitable threaded studs 204,206 comprise means for fastening the exterior handle 200 to door 10 in a stationary, non-movable position. Suitable grommets 208 and/or gaskets 210 may also be employed to prevent damage or stresses to the glass by the studs 204,206 or the ends of exterior handle 200.

As seen in FIG. 3, interior handle 100 is affixed to glass door 10 for limited pivotal movement between positions toward and away from the door by a pivoting nut assembly 500. Pivoting nut assembly 500, as seen in FIG. 3, comprises a nut member 502 pivotally connected to stud 206 by a pin 504. Handle 100 is affixed to nut member 502 by a screw member 506 disposed through handle 100. To prevent excessive play in handle 100, a pair of set screws 508 are provided in nut member 502 which can be adjusted to restrict the lateral movement of screw member 506 within dotted aperture 510 in nut member 502. To provide rigidity and strength to handle 100, a suitable filler material 102, such as aluminum or brass, is provided in handle 100 at the ends thereof.

The pivotal movement of handle 100 toward and away from door 10 actuates the latching assembly 600 to latch or unlatch the door. As illustrated in FIG. 3 handle 100 is in the forward position, i.e., closest to the door 10, whereby the latching assembly 600 is in the unlatched condition and the door 10 can be opened. As described more fully below, the latching assembly 600 comprises a latch sub-assembly 700 and a crank sub-assembly 800 in cooperative engagement with one another and in cooperative engagement with lock cylinder assembly 400.

Figure 5:
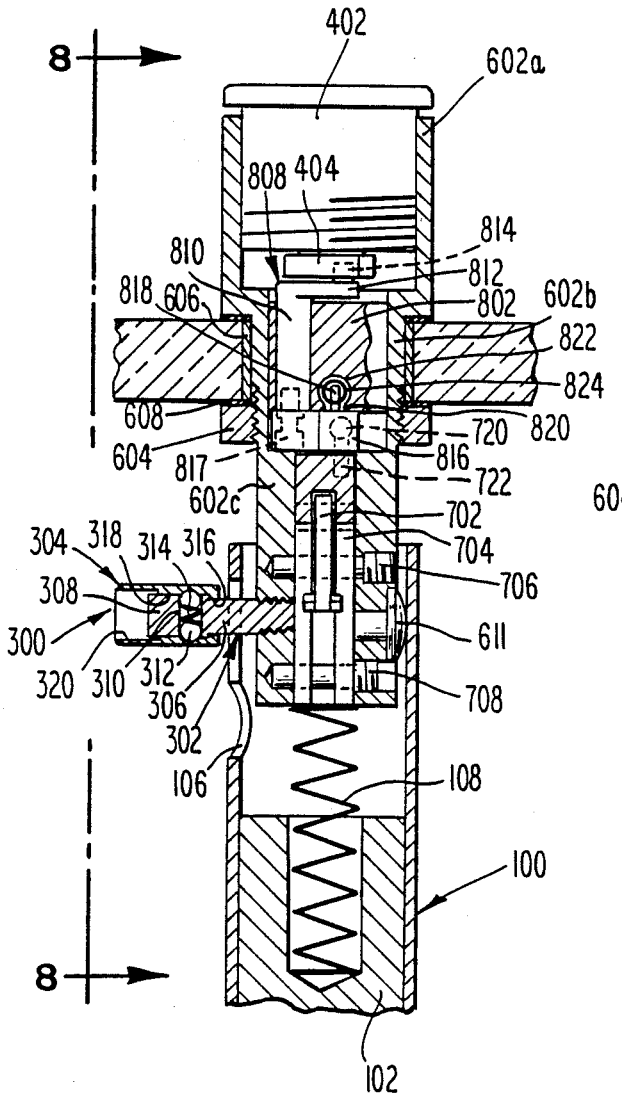
FIG. 5 is a fragmentary sectioned view of the panic handle of the present invention as seen along line 5—5 of FIG. 4.
Figure 4:
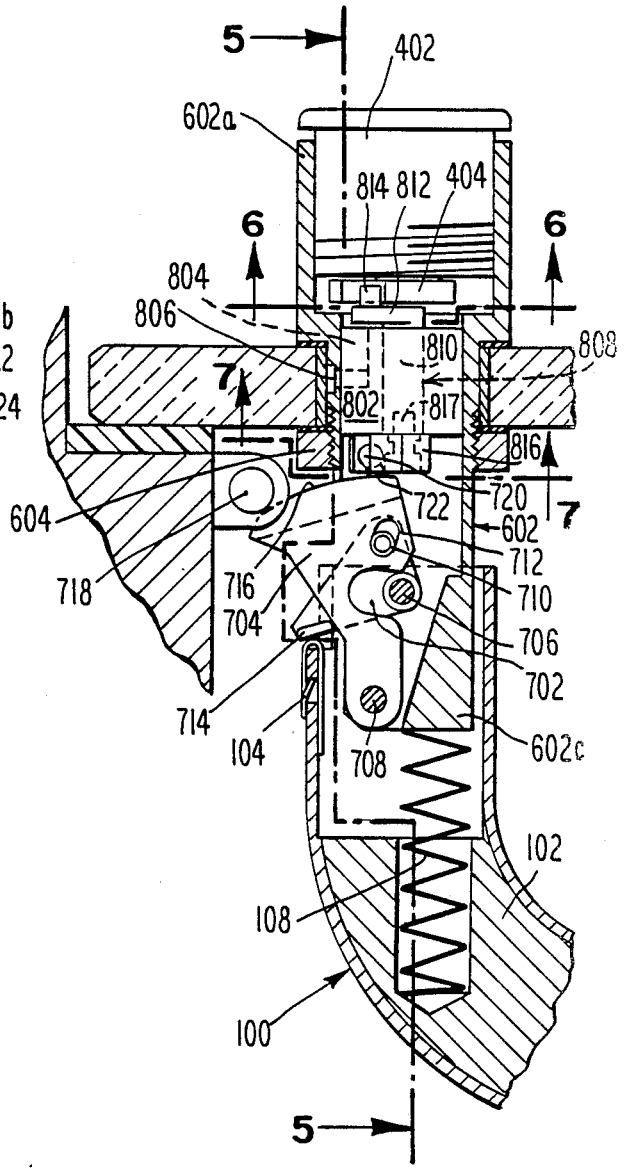
FIG. 4 is a fragmentary sectioned view of the glass door and panic handle of the present invention, similar to that of FIG. 3, with the exterior fixed handle not shown, and illustrating the panic handle in an undogged position, whereby the door is unlatched.

With reference now being made to FIGS. 4 and 5, as illustrated therein, interior handle 100 is in the position furthest from the door 10 whereby the latching assembly 600 is in the latched position and the door 10 is latched tightly against the door jamb. For purposes of clarity, optional exterior handle 200 is not shown in these Figures. As seen in these Figures, latching mechanism 600 comprises a housing 602 which is of a substantially cylindrical, tubular configuration and is preferably of metal construction. Housing 602 is adapted to be affixed to door 10 in substantially perpendicular orientation to the plane thereof, as shown. In the particular embodiment shown in the Figures, housing 602 is affixed to the glass door 10 by a collar member 604 in threaded engagement with housing 602 whereby the glass door 10 is clamped in sandwich relation between housing 602 and collar member 604. As before, a suitable grommet 606 and/or gaskets 608 may be used to protect the glass.

In the embodiment illustrated in the Figures, housing 602 is a one-piece member comprised of three discrete sections. A first section **602*a* is disposed on the exterior of the door 10 and comprising a housing for the lock cylinder assembly 400. A second section 602*b*, adjacent the first section 602*a*, is disposed substantially coplanar with the door 10 and comprising a housing for the crank sub-assembly 800. A third section 602*c*, adjacent the second section 602*b*, is disposed on the interior of the door 10 and comprising a housing for the latch sub-assembly 700. As also seen in the Figures, third section 602*c* is adapted to be received within handle 100 to facilitate the movement of handle 100 toward the door 10. Although housing 602 is illustrated in the drawings as a one-piece member, it is to be understood that a two-piece housing may be substituted therefore, whereby one of the two pieces would comprise section 602*a* in threaded engagement with the other of the two pieces which would comprise sections 602*b* and 602*c*. A two-piece housing of such construction would be particularly desirable in those situations, mentioned above, wherein the lock cylinder assembly 400 will not be used, in which case housing 602 would comprise only sections 602*b* and 602*c* and a threaded cap or the like would be used on the outside of door 10**.

Figure 6:
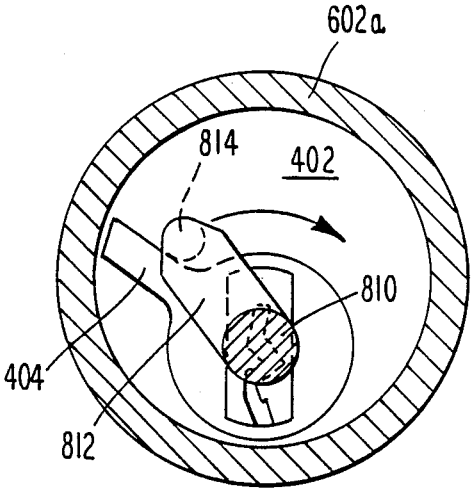
FIG. 6 is a sectional view of the panic handle of the present invention as seen along line 6—6 of FIG. 4, particularly illustrating the actuation of the crank sub-assembly by a lock cylinder means.

With reference to FIGS. 4–6, the lock cylinder assembly 400 comprises a lock cylinder means 402, which may be of any known construction, having movable locking tab means 404 connected thereto. The structure and shape of the locking tab means 404 is best seen in FIG. 6, as is the movement of the locking tab means 404 in actuating the crank sub-assembly to unlatch the door. The interrelationship between the lock cylinder assembly 400 and crank sub-assembly 800 will be described more fully hereinafter in connection with the operation of the present invention. Lock cylinder means 402, if employed, is disposed on the exterior of the door 10 and within the first section **602*a* of housing 602**.

The crank sub-assembly 800, as seen in the Figures, comprises a cylindrical member 802 which is sized to fit within second section **602*b* of housing 602. Cylindrical member 802 is provided with a slotted aperture 804 on the periphery thereof which is adapted to receive pin 806 therein, which pin 806 passes through the wall of housing 602 and retains the cylindrical member 802 in proper orientation within housing 602. Longitudinally disposed through cylindrical member 802 is a crank member 808 having a cylindrical shaft 810, a tab-like member 812 connected to shaft 810, and a pin 814 extending from the tab member 812. As seen in FIG. 3–6, pin 814 is adapted to engage locking tab 404, whereby upon movement of locking tab 404 in a clockwise direction (see FIG. 6), crank member 808 will rotate relative to cylindrical member 802**.

Figure 7:
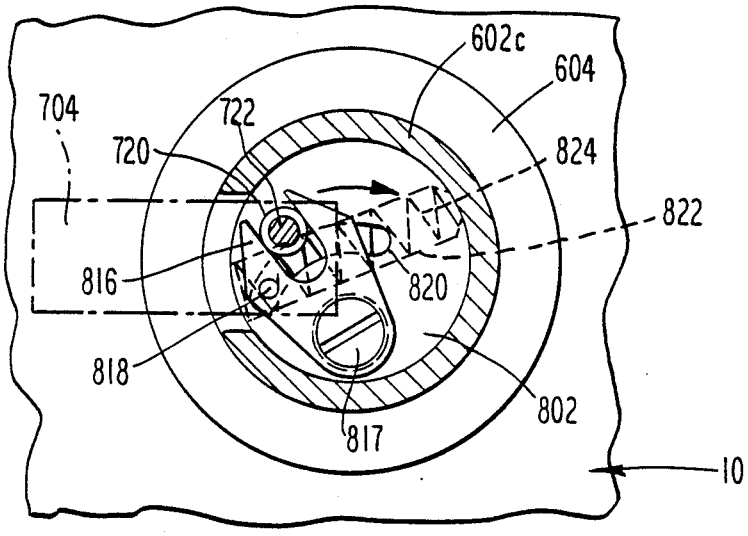
FIG. 7 is a sectional view of the panic handle of the present invention as seen along line 7—7 of FIG. 4, particularly illustrating the actuation of the latch sub-assembly by actuation of the crank sub-assembly.

At the end of shaft 810 opposite the connection to tab 812 is provided a yoke member 816, the structure of which is seen in FIG. 7, which is affixed to shaft 810 by a screw 817 or the like. As also indicated in FIG. 7, yoke 816 will rotate in like manner and direction with crank 808. As perhaps best seen in FIGS. 5 and 7, yoke member 816 is provided with a pin 818 which extends into arcuate slot 820 in cylindrical member 802. Disposed adjacent to arcuate slot 820 in cylindrical member 802 is a transverse bore 822 which houses a spring 824. Pin 818, as seen in FIG. 5 and 7, is adapted to engage spring 824, whereby spring 824 comprises means for biasing against the clockwise movement of yoke 816 as seen in FIG. 7.

With reference now being made to FIGS. 3–5, the latch sub-assembly 700 essentially comprises a lever 702 and a latch member 704. Lever 702, as seen in the Figures, is disposed within third section **602*c* of housing 602 and is pivotally connected thereto by a pivot screw 706. Likewise, latch member 704 is disposed within third section 602*c* of housing 602 and pivotally connected thereto by a pivot screw 708. Lever 702 and latch member 704 are connected together by a transverse pin 710 connected to lever 702 and disposed within a slotted aperture 712 of latch member 704. In comparing the positions of latch member 704 and lever 702 in FIGS. 3 and 4, it can readily be seen that lever 702 acts as an over-center member in operation of the latching assembly 700. More particularly, it can be seen that transverse pin 710 crosses the on-center position (defined by a theoretical line between pivot screws 706 and 708) as the latch member is moved between the extended (latched) position (shown in FIG. 4) and the retracted (unlatched) position (shown in FIG. 3**).

In the embodiment illustrated in the Figures, lever 702 is provided with a flattened strike plate 714 which is positioned to contact interior handle 100, with the portion of handle 100 which is to contact strike plate 714 being provided with a striker 104.

Latch member 704 is an irregular-shaped member having a curved peripheral edge 716 generally opposite the pivot connection of the latch member with housing 602. Peripheral edge 716 is of such size and configuration so as to make latch member 704 engageable with the latch detent 718 as seen in FIG. 4. (see also FIG. 8) As such, the curved shape of peripheral edge 716 facilitates the disengagement of latch member 704 and detent 718 when actuated, which is particularly desirable in panic-type latching systems for obvious reasons. Peripheral edge 716 of latch member 704 is also provided with a substantially spherical ball 704 which is connected to latch member 704 in spaced-relation to peripheral edge 716 by a support post 722. Ball 720 and support 722 are disposed on latch member 704 at a location so as to be engageable with yoke 816, with ball 720 being disposed within the central aperture of yoke 816, as seen in FIG. 7. In this arrangement, latch member 704 is pivotally movable between extended and retracted positions relative to housing 602 in response to rotational movement of yoke 816 and yoke 816 is rotatably movable in response to pivotal movement of latch member 704, the significance of which is detailed hereinbelow.

Figure 8:
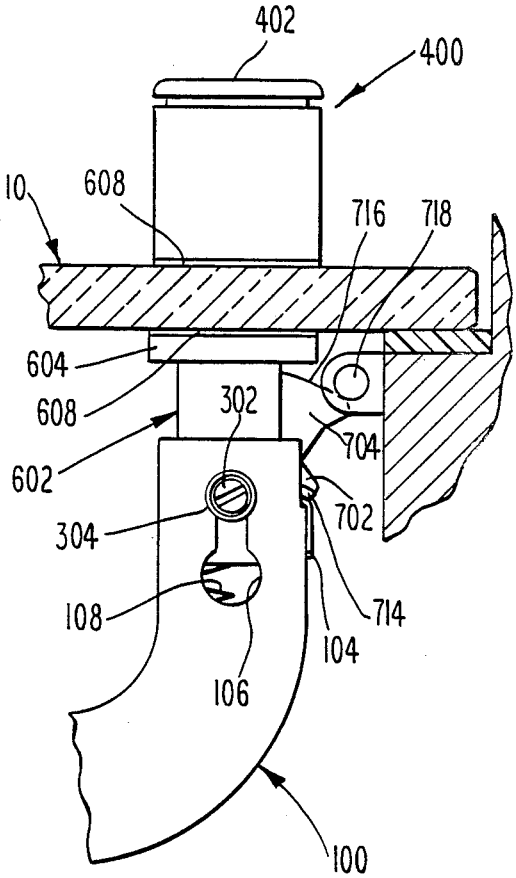
FIG. 8 is a partially fragmented, partially sectioned bottom plan view of the panic handle of the present invention as seen along line 8—8 of FIG. 5.

With reference to FIGS. 3, 5 and 8, the dogging assembly 300 comprises a post 302 which is adapted to be affixed to housing 602 and a cap 304 connected to post 302 in telescopic sliding relation thereto. Post 302, as seen in FIG. 5, comprises a substantially cylindrical member having a shank 306 adapted at one end to be fixedly attached to housing 602 and a stepped section 308 disposed at the other end of shank 306, with stepped section 308 being of greater diameter than shank 306. Stepped section 308 is provided with a transverse bore 310 into which is disposed a pair of ball-bearing members 312 urged apart by a spring 314. Cap 304, as seen in FIG. 5, is a substantially hollow cylindrical member having internally therein three distinct sections of differing diameter. The section of smallest diameter 316 is at the end of cap 304 which is closest to housing 302 and is of a lesser diameter than stepped section 308 of post 302, and thereby functions as a stop for the telescopic sliding movement of cap 304 into the disengaged position seen in FIG. 5. The diameter of this section corresponds with the diameter of shank 306.

Adjacent the section of smallest diameter 316 is intermediate section 318, the diameter of which substantially corresponds with the diameter of stepped section 308 of post 302. This section, by virtue of its interaction with bearings 312 and spring 314 when the dogging device is disengaged, facilitates the retention of the cap 304 in the disengaged position. The third section 320 is disposed adjacent section 318 and is of a greater diameter than section 318 whereby a shoulder is formed between these two sections. The shoulder provides resistance to the telescopic sliding movement of cap 304 from the engaged position to help facilitate positive engagement of the dogging device.

The function of dogging device 300 will now be explained with particular reference to FIGS. 2 and 8. As seen in FIG. 8, handle 100 is in its position away from door 10 and the door is latched. Dogging device 300 is connected to housing 602 and is disengaged. As also seen in FIG. 8, handle 100 is provided with a keyhole shaped slot 106 through which the dogging device is disposed. When handle 100 is moved to its position closest to door 10, cap 304 will be above the larger end of slot 106, wherein upon movement of cap 304 toward housing 602 and handle 100, cap 304 will be disposed within slot 106 (see FIG. 2) and handle 100 will remain in its forewardmost position until the cap 304 is pulled out of its engaged position. Thus, when dogging device 300 is engaged, handle 100 is no longer movable relative to door 10 and handle 100 functions as a stationary door handle.

The operation of the present invention to latch and unlatch the door will now be described with particular reference to FIGS. 3–7. As is obvious from the above discussion, from the latched position illustrated in FIG. 4, the door can be unlatched by actuation of either interior handle 100 or by actuation of the lock cylinder means 400. With respect to the latter method of actuation, actuation of lock cylinder 402, such as by a key, will cause locking tab 404 to rotate in a known manner. In the position illustrated in the Figures, locking tab 404 will rotate in a clockwise direction as seen in FIG. 6. Upon rotation of locking tab 404, crank member 808 will rotate within cylindrical member 802 by virtue of engagement of locking tab 404 and pin 814. (See FIG. 6) The rotation of crank member 808, in turn, will cause yoke 816 to rotate in the clockwise direction against the bias of spring 824. (See FIG. 7) The rotation of yoke 816 will cause latch member 704 to move to the right (as seen in FIGS. 4 and 7) via ball 720 and support 722, whereby latch member will be retracted into housing 602 into the position illustrated in FIG. 3. The movement of latch member 704 will disengage the latch member from detent 718 and will also cause lever 702 to retract, whereby door 10 is unlatched and can be opened in a normal manner. When the lock cylinder means 400 is no longer actuated, spring 824 will cause the yoke 816 to return to the position illustrated in FIGS. 5 and 7, which in turn will restore crank member 808, latch member 704 and lever 702 to their respective positions illustrated in FIG. 5.

When it is desired to unlatch the door using the interior handle assembly 100, such as in a panic situation, handle 100 is moved, against the bias of spring 108, toward door 10. Striker 104 engages strike plate 714 which causes lever 702 to pivot in a clockwise direction (as seen in FIG. 4) about pivot screw 706. The pivoting of lever 702, in turn, causes latch member 704 to pivot in the clockwise direction by means of pin 710 and slot 712. Pivoting of latch member 710 will cause the latch member to retract into housing 602 and out of engagement with detent 718. Also, the retraction of latch member 704 will, by means of ball 720, cause yoke 816 and crank 808 to rotate against the force of spring 824. Once the latch member 704 is retracted, the door is unlatched and can be opened in a normal manner. Upon release of interior handle assembly 100, the bias of springs 108 and 824 will return handle 100, latch member 704, lever 702, yoke 816 and crank member 808 to their original positions. If desired, the dogging device can be engaged to fix interior handle 100 in its forward position whereby the door 10 will be unlatched until the dogging device is manually disengaged.

In the preferred embodiment of the present invention, handle 100 and housing 602 are made of metal construction and contact between the two during movement of handle 100 would likely cause undesirable noise. Thus, as seen in FIG. 5, housing 602 is provided with a buttom shaped spacer 611 which is of such size and shape so as to contact the interior of handle 100. As such, spacer 611 helps prevent contact between housing 602 and handle 100 and thus reduces undesirable noise during operation of the panic handle.

As is obvious from a reading of the specification, the present invention amply fulfills the object thereof. It is to be understood, however, that the particular embodiments illustrated and described herein are for purposes of illustration only and are not to be construed as limitations on the present invention. Furthermore, various modifications and alternatives may suggest themselves to one skilled in the art upon a reading of the present specification, all of which are intended to be within the spirit and scope of the present invention as defined in the appended claims.

What is claimed is:

1. In combination, a panic handle and a door, comprising:

(a) a bar disposed horizontally along and carried by the inside of a door;

(b) pivot means for allowing limited pivotal movement of said bar between positions toward and away from the door; and (c) a latching assembly comprising a housing affixed to the door and extending into said bar, said latching assembly being operably engaged with said bar for movement between unlatched and latched conditions upon respective movement of said bar toward and away from said door.

2. The combination of claim 1, wherein said latching assembly further comprises a latch sub-assembly disposed within said housing and in operable engagement with said bar.

3. The combination of claim 2, wherein said latch subassembly comprises:

(a) a latch pivotally connected to said housing for pivotal movement between extended and retracted positions relative to said housing; and (b) a lever pivotally connected to said housing, connected to said latch, and in contact with said bar, wherein said lever is pivotally movable in response to movement of said bar and wherein said latch is pivotally movable in response to movement of said lever.

4. The combination of claim 3, wherein said lever comprises an over-center member.

5. The combination of claim 3, further comprising latch biasing means for biasing said latch into said extended position; and bar biasing means for biasing said bar into said position away from said door.

6. The combination of claim 2, further comprising:

(a) lock cylinder means affixed to said housing and disposed on the outside of said door, said lock cylinder means having movable locking tab means connected thereto; and (b) a crank sub-assembly disposed within said housing between said lock cylinder means and said latch subassembly, said crank sub-assembly comprising means for actuating said latch sub-assembly by movement of said locking tab means.

7. The combination of claim 6, wherein said crank subassembly comprises:

(a) a substantially cylindrical member disposed within said housing and fixed against rotation relative thereto;

(b) a longitudinal bore within said cylindrical member;

(c) a crank disposed within said longitudinal bore for rotational movement therein in response to movement of said locking tab means; and (d) a yoke affixed to said crank and in operable engagement with said latch sub-assembly for actuation of said latch sub-assembly between latched and unlatched conditions in response to rotational movement of said crank.

8. The combination of claim 7, wherein said latch subassembly comprises:

(a) a latch pivotally connected to said housing and in operable engagement with said yoke, said latch being pivotally movable between extended and retracted positions relative to said housing in response to movement of said yoke;

(b) a lever pivotally connected to said housing and connected to said latch for pivotal movement in response to movement of said latch, said lever comprising an over-center member; and (c) wherein said lever is in contact with said bar whereby upon movement of said bar, said latch is pivotally movable between said extended and retracted positions.

9. The combination of claim 1, further comprising dogging means for fixedly securing said bar in said position toward said door, whereby said latching assembly is unlatched and said bar functions as a stationary door handle.

10. The combination of claim 9, wherein said dogging means comprises:

(a) a support post affixed to said latching assembly;

(b) a cap disposed on said post for telescopic sliding movement relative thereto between dogged and undogged positions, said cap being selectively operably engageable with said bar when said bar is in said position toward the door, whereby said cap, when in said dogged position, prevents movement of said bar into said position away from said door; and (c) means for resisting the telescopic sliding movement of said cap relative to said support post.

11. The combination of claim 10, wherein said resistance means comprises a pair of ball bearings disposed within a transverse bore in said support post; and spring means for urging said ball bearings apart and into contact with an inner stepped surface of said cap, whereby the movement of said cap from the dogged position to the undogged position is against the bias of said spring means.

12. The combination of claim 1, wherein said door is of the lass-like type.

13. The combination of claim 1, wherein said door is provided with a stationary handle on the exterior of said door.

14. In combination, a panic handle and a door, comprising:

(a) a bar disposed horizontally along and carried by the inside of a door;

(b) pivot means for allowing limited pivotal movement of said bar between positions toward and away from the door;

(c) a latching assembly comprising:

(1) a housing affixed to the door and extending into said bar;

(2) a latch sub-assembly disposed within said housing and in operable engagement with said bar;

(3) a crank sub-assembly disposed within said housing and adjacent to said latch sub-assembly, said crank sub-assembly being in operable engagement with said latch sub-assembly;

(d) wherein said latch sub-assembly is operably movable between latched and unlatched positions in response to pivotal movement of said bar; and (e) wherein said latch sub-assembly is operably movable between latched and unlatched positions in response to actuation of said crank sub-assembly.

15. The door and panic handle combination of claim 14, wherein said latch sub-assembly comprises:

(a) a lever pivotally connected to said housing and in contact with said bar for pivotal movement in response to movement of said bar;

(b) a latch pivotally connected to said housing and connected to said lever, said latch being pivotally movable between extended and retracted positions relative to said housing in response to pivotal movement of said lever; and (c) wherein said lever comprises an over-center member for securing said latch in said extended position.

16. The door and panic handle combination of claim 15, wherein said crank sub-assembly comprises:

(a) a substantially cylindrical member disposed within said housing and fixed against rotation relative thereto;

(b) a longitudinal bore in said cylindrical member;

(c) a crank disposed within said bore for rotational movement therein; an (d) a yoke affixed to said crank for rotational movement therewith, said yoke being connected to said latch for pivotal movement of said latch between said extended and retracted positions in response to rotational movement of said crank.

17. The door and panic handle combination of claim 16, further comprising a lock cylinder means affixed to said housing on the outside of said door, said lock cylinder means having movable locking tab means connected thereto; said locking tab means being in contact with said crank whereby said crank is rotatably movable in response to movement of said locking tab means.

18. The door and panic handle combination of claim 17, further comprising dogging means for fixedly securing said bar in the position toward said door, whereby said latch sub-assembly is unlatched and said bar functions as a stationary door handle.

19. The door and panic handle combination of claim 18, wherein said dogging means comprises:

(a) a support post affixed to said housing;

(b) a cap disposed on said post for telescopic sliding movement relative thereto between a dogged position toward said housing and an undogged position away from said housing;

(c) a transverse bore in said support post;

(d) a pair of ball bearings disposed within said bore and urged apart by a spring and into contact with an inner surface of said cap;

(e) said inner surface of said cap having a stepped configuration wherein movement of said cap from said dogged position to said undogged position is against the bias of said spring; and (f) said bar being adapted for being engageable with said cap when said bar is in said position toward said door and said cap is moved to said dogged position, whereby said bar is substantially prevented from movement relative to said door.

20. The door and panic handle combination of claim 19, further latch biasing means for biasing said latch into said extended position; and bar biasing means for biasing said bar into said position away from said door.

21. The door and panic handle combination of claim 20, wherein said latch biasing means comprises a spring disposed within a transverse bore in said cylindrical member and in contact with

22. The door and panic handle combination of claim 21, wherein said bar biasing means comprises a spring disposed between said bar and said housing.

23. The door and panic handle combination of claim 22, wherein further comprises rattle prevention means disposed thereon and in contact with said bar to prevent rattle between said housing and said bar upon movement of said bar.

24. The door and panic handle combination of claim 14, wherein said door is provided with a stationary handle on the outside of said door.

25. The door and panic handle combination of claim 14, wherein said bar is of the generally hollow-type.

26. The door and panic handle combination of claim 14, wherein said door is of the glass-like type.

27. A panic handle for a door, said panic handle comprising:

(a) a bar;

(b) pivot means adapted to be affixed to a door and pivotally connected to said bar at a terminal end thereof, said pivot means comprising means for allowing limited pivotal movement of said bar between positions toward and away from a door when said pivot means and said bar are affixed to a door, wherein said pivotal movement of said bar has a single axis located at the pivot connection between said bar and said pivot means; and (c) a latching assembly adapted for being affixed to a door and in operative engagement with said bar for movement between latched and unlatched conditions in response to pivotal movement of said bar; said latching assembly comprising:

(1) a housing adapted for being affixed to a door;

(2) a latch sub-assembly having (i) a latch pivotally connected to said housing for movement between extended and retracted positions relative to said housing;

(ii) a lever pivotally connected to said housing, connected to said latch, and in contact with said bar, wherein said lever is pivotally movable in response to movement of said bar and wherein said latch is pivotally movable in response to movement of said lever;

(iii) wherein said lever comprises an over-center member; and (3) a crank sub-assembly having (i) a substantially cylindrical member disposed within said housing and fixed against rotation relative thereto;

(ii) a longitudinal bore in said cylindrical member;

(iii) a crank disposed within said longitudinal bore for rotational movement therein;

(iv) a yoke affixed to said crank and in operable engagement with said latch;

(v) wherein said crank is rotatably movable in response to pivotal movement of said latch and wherein said latch is pivotally movable in response to rotational movement of said crank.

28. The panic handle of claim 27, further comprising:

(a) lock cylinder means affixed to said housing;

(b) said lock cylinder means having movable locking tab means connected thereto; and (c) wherein said movable locking tab means is in operable engagement with said crank and comprises means for rotating said crank in response to actuation of said lock cylinder means.

29. The panic handle of claim 28, further comprising latch means for biasing said latch into said extended position; and bar biasing means for biasing said bar away from said housing of said latching assembly.

* * * * *

UNITED STATES PATENT AND TRADEMARK OFFICE

CERTIFICATE OF CORRECTION

PATENT NO. : 4,895,399

DATED : January 23, 1990

INVENTOR(S) : William J. Horgan, Jr.

It is certified that error appears in the above-identified patent and that said Letters Patent is hereby corrected as shown below:

Col. 9, line 25, delete "lass" and add therefor -- glass --;
Col. 10, line 3, delete "an" and add therefor -- and --;
line 48, after "with" add the words -- said yoke --;
line 53, after "wherein" and before "further" add the words -- said housing --;
Col. 12, line 23, after "latch" and before "means" add the word -- biasing --.

Signed and Sealed this

Fourth Day of June, 1991

*Attest:*

HARRY F. MANBECK, JR.

*Attesting Officer*

*Commissioner of Patents and Trademarks*